US009162740B2

(12) United States Patent
Hardy et al.

(10) Patent No.: US 9,162,740 B2
(45) Date of Patent: Oct. 20, 2015

(54) UNDERSEA FREE VEHICLE AND COMPONENTS

(71) Applicants: Kevin Richard Hardy, San Diego, CA (US); Jonas Dean Cochran, San Diego, CA (US)

(72) Inventors: Kevin Richard Hardy, San Diego, CA (US); Jonas Dean Cochran, San Diego, CA (US)

( * ) Notice: Subject to any disclaimer, the term of this patent is extended or adjusted under 35 U.S.C. 154(b) by 0 days.

(21) Appl. No.: 14/170,197

(22) Filed: Jan. 31, 2014

(65) Prior Publication Data

US 2014/0216325 A1 Aug. 7, 2014

Related U.S. Application Data

(60) Provisional application No. 61/761,810, filed on Feb. 7, 2013.

(51) Int. Cl.
*B63G 8/00* (2006.01)

(52) U.S. Cl.
CPC ..... *B63G 8/001* (2013.01)

(58) Field of Classification Search
CPC ..... B63G 8/00; B63G 8/001; B63G 8/41; B63G 8/42; B63G 2008/00; B63G 2008/002; B63G 2008/004; B63G 2008/42; B63G 2008/425
USPC ..... 114/312, 313, 321, 322, 325, 330, 342
See application file for complete search history.

(56) References Cited

U.S. PATENT DOCUMENTS

| | | | | |
|---|---|---|---|---|
| 4,721,055 | A | 1/1988 | Pado | |
| 5,711,244 | A * | 1/1998 | Knapp | 114/312 |
| 7,131,389 | B1 * | 11/2006 | Hawkes | 114/330 |
| 8,448,592 | B2 | 5/2013 | Crowell et al. | |
| 2012/0006245 | A1 | 1/2012 | Lundberg | |

* cited by examiner

*Primary Examiner* — Daniel V Venne
(74) *Attorney, Agent, or Firm* — Mark Wisnosky

(57) ABSTRACT

A free vehicle suitable to serve as a platform to carry a variety of equipment to the ocean floor, actuate devices at the floor and at intermediate points on the way to and returning from the ocean floor is described. The free vehicle includes standardized power, control electronics, navigation equipment and mechanical release mechanisms that can be used in conjunction with custom experiments. Exemplary experiments include sensors and sampling equipment used for deep-sea exploration. The free vehicle platform provides for scalable designs to meet scientific needs and surface vessel constraints.

9 Claims, 11 Drawing Sheets

UNDERSEA FREE VEHICLE AND COMPONENTS

CROSS-REFERENCE TO RELATED APPLICATIONS

This application claims priority to U.S. Provisional application 61/761,810 filed on 7 Feb. 2013, titled Beacon Board for Surface Detection of Floating Device by the same inventors and currently pending.

BACKGROUND OF THE INVENTION

1. Technical Field

The present invention relates to an undersea vehicle for research applications and components thereof 2. Related Background Art Access to the seabed has been by possible for centuries using ropes of various compositions, chains, and as of the middle of the 20th Century, by free vehicles. Free vehicles are chambers that can contain observational or sampling equipment that operate autonomously within the ocean depths. Free vehicles operate independently of the surface or ships by the sequential control of buoyancy. In the simplest configuration, a positive buoyancy module, also called "flotation," is overcome by a larger negative weight, also called an "anchor," making the vehicle's net density greater than seawater, and therefore able to sink to the sea floor. After a period of time, which can vary from a few seconds to multiple years, the anchor is released from the flotation, making the upper package less dense than seawater. It now floats to the surface, generally carrying with it physical samples, recorded data, or both.

Heretofore the free vehicles have been custom made for a specific mission or task. Some vehicles are made for a particular observation and others are constructed for particular sampling tasks, including collecting water at varying depths or biological and geological samples from the ocean floor. There are no general-purpose free vehicle platforms that can be adapted to a variety of purposes.

Prior art free vehicle platforms are attached to an anchor that drags them to the ocean floor. Once below the surface communication with the free vehicle becomes a challenge. The water is opaque to radio waves so communication must be through wires or acoustically. The extreme ocean depths frequently explored make sending commands to the free vehicle impossible. The free vehicle must be able to operate autonomously. The autonomous operation must include determining when the vehicle will release from the anchor and return to the ocean surface for recovery. Prior art release has included anchor connections that corrode at a known rate such that the free vehicle will literally break free from the anchor after a pre-selected time. The rate of corrosion however is rarely consistent. Local water chemistry, temperature and currents affect the corrosion rate such that the time of release of the free vehicle can vary significantly. Electronic timers can be used to trigger release events however release mechanisms that operate consistently at extreme ocean depths are heretofore not available. Autonomous operation must further include reliable mechanisms to shutdown electronic devices once the vehicle is submerged and to restart the devices once it resurfaces. Electronic devices must be shut down to conserve battery life for what can be submerged missions that last for days.

Locating a free vehicle once the measurements or sampling is completed is also difficult. With currents potentially moving the free vehicle some distance from the drop point, or a dark night, overcast or storms, it may be difficult to locate the small but expensive floating device as it sits low in the water. Further, biological samples carried from the depths may be sterilized by the warm surface waters in a matter of 30 minutes or less. Ship costs can run over $40,000/day, and any delay can be expensive. Thus, it is crucial to locate and recover the device in the shortest period of time. Finding the device is critical to a mission's success. Use of a radio direction finder homing beacon allows skilled operators using null meters to determine the approximate direction, but not range. Skill is required as the indicated direction may be out by 180-degrees, and the ship could head directly away from the free vehicle. There are two prior art beacons that utilize global positioning satellites and satellite communication to transmit a floating beacons location. Buoys and free vehicles using the Argos® systems (Argos is a registered trademark of Collecte Localisation Satellites C.L.S. société anonyme (sa) of France) sends the received position to a computer email address, therefore requiring a satellite link to the Internet to access the required information. Such links are often not accessible at sea. MetOcean Data Systems of Canada forwards the positional information from a drifting surface buoy via a satellite telephone to a land-based service that then relays the coordinates back to the ship through a satellite telephone, a loop process that can have significant delay and result in difficulty in locating a free vehicle drifting in ocean currents. The current methods are slow, costly, and less capable as they only provide the location of the floating device, but not a bearing and range relative to the ship. Additionally, navigational charts must be employed to find the broadcasting devices location relative to the recovery ship.

There is a need for a vehicle platform that can be adapted to a variety of uses. There is a need for a free vehicle that uses a standard set of parts and procedures for traversing ocean depths and returning and still provides a cargo bay for custom experiments. There is a need for a free vehicle system that is expandable to handle a variety of experiments and allows for communication amongst all experiments simultaneously immersed. There is a need for a free vehicle platform that can operate autonomously at ocean depths. There is a need for a free vehicle platform that can be precisely released from an anchor so that it may be quickly and efficiently recovered. There is a need for a platform that can be located at sea by broadcasting its location and heading to a recovery vessel over long distances. The free vehicle requires a combination of capabilities to perform. There must be mechanisms in place for autonomous operation including shutdown and startup procedures for portions of the onboard electronics as the vehicle is submersed, there must be reliable attachment and release mechanisms for the anchor, and there must be robust position and communication systems to retrieve the free vehicle when it resurfaces. Additionally for cost and reliable operation there is a need for a free vehicle that isolates the navigation features of the vehicle from the cargo experiment features of the vehicle, such that navigation can be done repeatedly and reliably while the onboard experiments may be customized for each trip to the ocean floor.

DISCLOSURE OF THE INVENTION

A system is described that addresses the deficiencies of the current art systems described above. A first embodiment includes a free vehicle platform that is comprised of a switch triggered by pressure that can switch electronics on and off as the vehicle is submersed and returns to the surface, a magnetic switch that allows control of the internal electronics of the vehicle through the outer wall of the vehicle, a control board operating in conjunction with the switches and electronics to control the onboard navigation electronics, release of the anchor and other on board electronics, a latch to reliably hold the free vehicle to an anchor for submersion and also can release the free vehicle platform from the anchor using either an electronic signal or through a corrosion mechanism or both, a switch mechanism on the control board that can provide a selectable pulse width signal to a device for turning it on and off or for other functions. Another embodiment includes a pressure-activated switch that is designed to pass through the housing wall of a free vehicle platform. The switch is designed to withstand the pressures at the deepest of oceans and is adjustable such that it is actuated by pressure at adjustable depths. Another embodiment includes a latch mechanism that is activated by an electrical signal or by controlled erosion of a fusible link or both. The latch mechanism is suitable for attaching a free vehicle platform to an anchor. Another embodiment includes a communication link that allows contiguous but independent pressure housings in a single free vehicle platform to be linked together to communicate through the housing outer walls through either wireless radio frequency or optical signals. Another embodiment includes a GPS system and electronics that allows communication of the device position and heading to a recovery vehicle via a VHF signal. These features provide for simple reconfiguration of the free vehicle platform to multiple payloads.

The free vehicle platform as discussed here is implemented within a glass sphere housing. Adaptations may be made to allow the operation inside of metallic or ceramic housings by placing the GPS and radio transmitter antennas on the outside of the case. Removing the GPS and radio antennas to outside the glass may also be done to improve line-of-sight range and stability of reception in rough weather.

MODES FOR CARRYING OUT THE INVENTION

Figure 1:
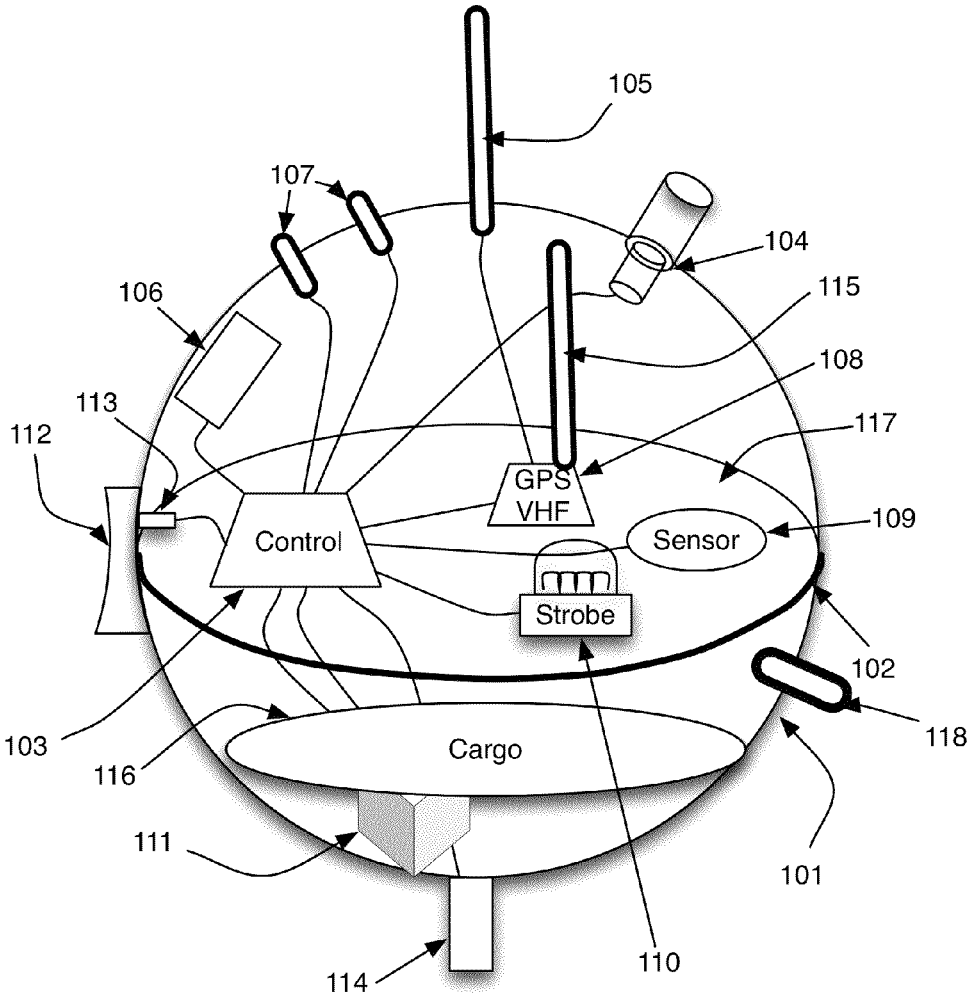
FIG. 1 is a block diagram showing a system for practicing the invention.

Referring to FIG. 1 an exemplary system used to practice the invention is shown. The free vehicle is comprised of a housing 101 that either contains components in its interior or has components attached to its exterior. The housing is restrained within a free flooding frame, not shown, that permits the assembly of all the components herein described as a single integral platform that may be simply deployed and recovered from a surface vessel. In the embodiment shown the housing is a sphere. The sphere may be made of glass, plastic, metal or any other material that can form a sealed environment and operate at the pressures encountered at ocean depths. In the embodiment shown a glass sphere is used. The sphere in the present embodiment is comprised of two hemispheres that are joined at a lap joint 102. Other embodiments include cylinders, boxes and irregular shapes. In use in deep-sea operations the housing is sealed and partially evacuated and/or purged with dry air or nitrogen through an evacuation port 118. In one embodiment a sensor 109 internal to the housing indicates the internal pressure to allow control of the evacuation process. The housing as shown includes two mounting plates 116, 117. The top mounting plate 117 is used for attachment of most components that are used repeatedly for control and navigation of the free vehicle. The lower mounting plate 116 forms a cargo area to which equipment such as measurement devices and data loggers may be attached. In use, the control and navigation components are typically standardized and the cargo elements (none shown) are customized for each experiment or task for the free vehicle. Non-limiting examples of customized tasks include photography, monitoring ocean conditions using a variety of sensors for measurements such as temperatures, currents, chemistry, and equipment to acquire water and ocean floor samples. Components of the free vehicle that are standardized include a control board 103. In a preferred embodiment the control board is a printed circuit board that controls the supply of power to the components of the free vehicle and sends and receives data from sensors within and attached to the free vehicle. Another component includes a pressure-activated switch 104. The switch is attached to the housing through a precise hole bored through the wall from the exterior to the interior. The switch 104 is activated by the increased external pressure and is used to either turn off components that are not used once the free vehicle is submerged or turn components on at a selected depth. The details of the switch are discussed below in conjunction with FIG. 4. The free vehicle further includes electronic components both interior to the housing and on the exterior. In one embodiment the exterior components are attached using a through hole drilled in the housing and sealed using o-rings or similarly to a through hull fitting on ships as are known in the art. The embodiment shown includes an exterior antenna 105 and an interior antenna 115. In the embodiment shown the free vehicle includes a global positioning device (GPS) 108 that includes the ability to detect the free vehicle's position using the global satellite network and also to broadcast the position of the free vehicle via a VHF radio signal. One of the antennae 115 attached to the GPS device is an antenna to send and receive signals to positioning satellites and the other antenna 105 is an antenna to send and receive a VHF signal. In one embodiment the pressure switch 104 is used to turn off the GPS and VHF devices 108 as the free vehicle is submerged and cannot receive radio signals and also turns the GPS and VHF devices back on as the free vehicle resurfaces. In a preferred embodiment the GPS and VHF functionality are combined in a single device such as the DC40 product manufactured by Garmin International incorporated of Olathe, Kans. 66062 USA. The power to the GPS unit and the control to turn the GPS unit on and off is from the control board 103. The control board 103 includes power circuitry to ensure stable power of the right voltage is supplied to the GPS unit as well as to other sensors 107, 109 included in the free vehicle. The free vehicle includes a range of sensors located both internal to the housing 109 and located on the outside of the housing 107. Sensors are connected to the control board 103 that provides power, on/off control and data acquisition from the sensors. The free vehicle further includes a magnetically activated switch 106 such that a magnetic placed on the outside of the free vehicle will activate the switch. This enables control of the free vehicle by personnel without the need to open the free vehicle to the atmosphere. The free vehicle further includes a strobe light 110 or other similar lighting systems such as an light emitting diode (LED) or LED array to aid finding the free vehicle once it surfaces. The strobe 110 is powered and controlled by the control board 103.

In another embodiment multiple housings, such as glass spheres or cylinders, may be linked together within the frame of a single free vehicle platform to increase capabilities and cargo area. In one embodiment communication between a pair of housings within the frame of a single free vehicle platform is made through a communication block 112 that is shaped to fit the outer shape of the housing, including, but not limited to, a glass sphere, glass cylinder, plastic sphere, or plastic housing. The communication block displaces seawater between two housings and enables communication either via radio wave or optically through a communication port 113. In the example shown the communication port is aligned to aim through the communication block as may be required for an optical or other line of sight device. In another embodiment the communication port 113 may be located anywhere within the housing. The latter case would be true of a radio wave communication port.

Power to components of the free vehicle is provided by a battery 111. The battery powers the control board 103 that in turn steps the voltage to the appropriate value for any of the components and switches the power to the components on and off at pre-selected times. In another embodiment shown in FIG. 2 the battery 205 is located exterior to the housing and wired connections to the control board use a connector 207 passing through the outer wall of the housing. In this manner batteries may be replaced or recharged when depleted without opening the housing within the free vehicle platform.

In another embodiment the free vehicle platform further includes an anchor attachment mechanism 114. The details of the anchor attachment mechanism are discussed later in conjunction with FIG. 7A and FIG. 7B. The anchor attachment is connected to an anchor (not shown) that is of sufficient weight to overcome buoyancy and submerge the free vehicle. The anchor attachment mechanism 114 may be electronically released by a signal from the control board 103, from an acoustic command unit, not shown, or by corrosion and breaking of a Galvanic Time Release (GTR) link. In another embodiment both an electronic and a corrosion of a link are used to release the anchor attachment mechanism thereby freeing the free vehicle from the anchor and allowing it to float to the water's surface.

Figure 2:
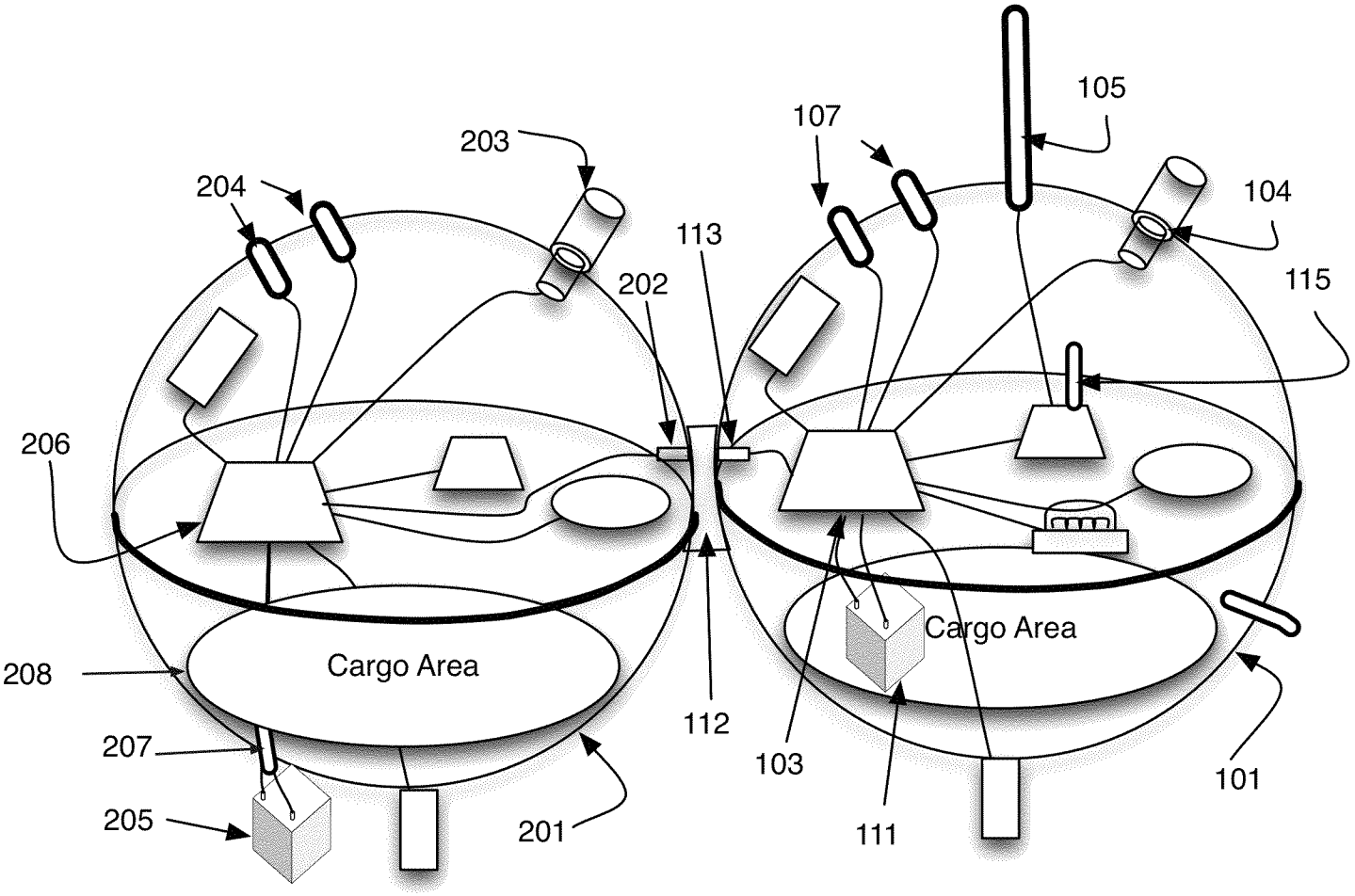
FIG. 2 is a diagram of two independent spherical housings as maybe located within a common free vehicle platform, joined together with a communication block.

Referring now to FIG. 2 an embodiment with two housings placed contiguous to each other within a common frame, not shown, is illustrated. The two housings may be duplicates of that shown in FIG. 1, or the second housing 201 may contain fewer components providing redundancy for only critical components, or the second housing may be used exclusively for expanded cargo area. In the example shown the first housing 101 is adjoined to the second housing 201 meeting at a communication block 112. The housings 101, 201 are held in contact by a clamping mechanism associated with a common frame (not shown). The housing 101 includes the components already discussed in conjunction with FIG. 1. In particular a control board 103 is included which gets power from a battery 111 and controls the operation of sensors 107, only two of which are labeled in FIG. 2. The battery 111 in the housing 101 is internal to the vehicle. The housing includes a communication port 113 that communicates with a similar communication port 202 in the second housing via the communication block 112. In the embodiment as shown the communication ports 113, 202 are aligned and are suitable for both line of sight communications such as optical and communications that do not require line of sight such as radio wave communication. In the latter case the communication ports 113, 202 are not necessarily located as shown but can be located in any location within or upon the associated housing. The second housing 201 can contain some or all of the components of the first housing 101. In the embodiment shown in FIG. 2 the second housing 201 includes a control board 206 attached to a battery 205. In the embodiment shown the battery 205 is external to the free vehicle and connection to the control board are through wires passing through a port 207 bored through the wall of the second housing 201. The second housing further includes sensors 204 attached to the control board 206. The embodiment further includes a pressure switch 203 that is a duplicate of the pressure switch 104 on the first housing. This represents an example of redundancy. Should the pressure switch on the first housing fail, the pressure switch on the second housing 203 can be used instead to either shutdown or activate systems and sensors as the paired housings submerge. In another embodiment functionality is limited to a single control board of the paired housings. The GPS antenna 115 and the VHF antenna 105 are used in the first housing 101 but not on the second housing 201. The second housing 201 may take advantage of this functionality through the communication ports 202, 113 to access the functionality located exclusively on one of the paired housings. This may be necessary should the first housing 101 be positioned above the second housing 102, thereby blocking the second housing's view to the GPS satellites. Functionality can be located in either of the paired housings 101, 201, and accessed by both control boards 103, 206 through the communication ports 113, 202. The second housing 201 further includes cargo area 208 for customized experiments and functions. The cargo area in the second housing may be expanded into regions within the second housing that are occupied by basic navigational functionality in the first housing if desirable. In another embodiment (not shown) the entire volume of the second housing 201 is used for cargo area and all navigational functions are contained in the first housing 101. In another embodiment (not shown) a plurality of housings are joined together in the same manner as depicted here for just two housings. The functionality of cargo area, navigational components and buoyancy may be split between the plurality of housings. In one embodiment components critical for navigation of the free vehicle are duplicated amongst the plurality of housings thereby providing redundancy of critical components. A non-limiting list of critical components includes the control board, a GPS component, a VHF radio component, the strobe or lighting component, and anchor release circuitry.

Figure 3A:
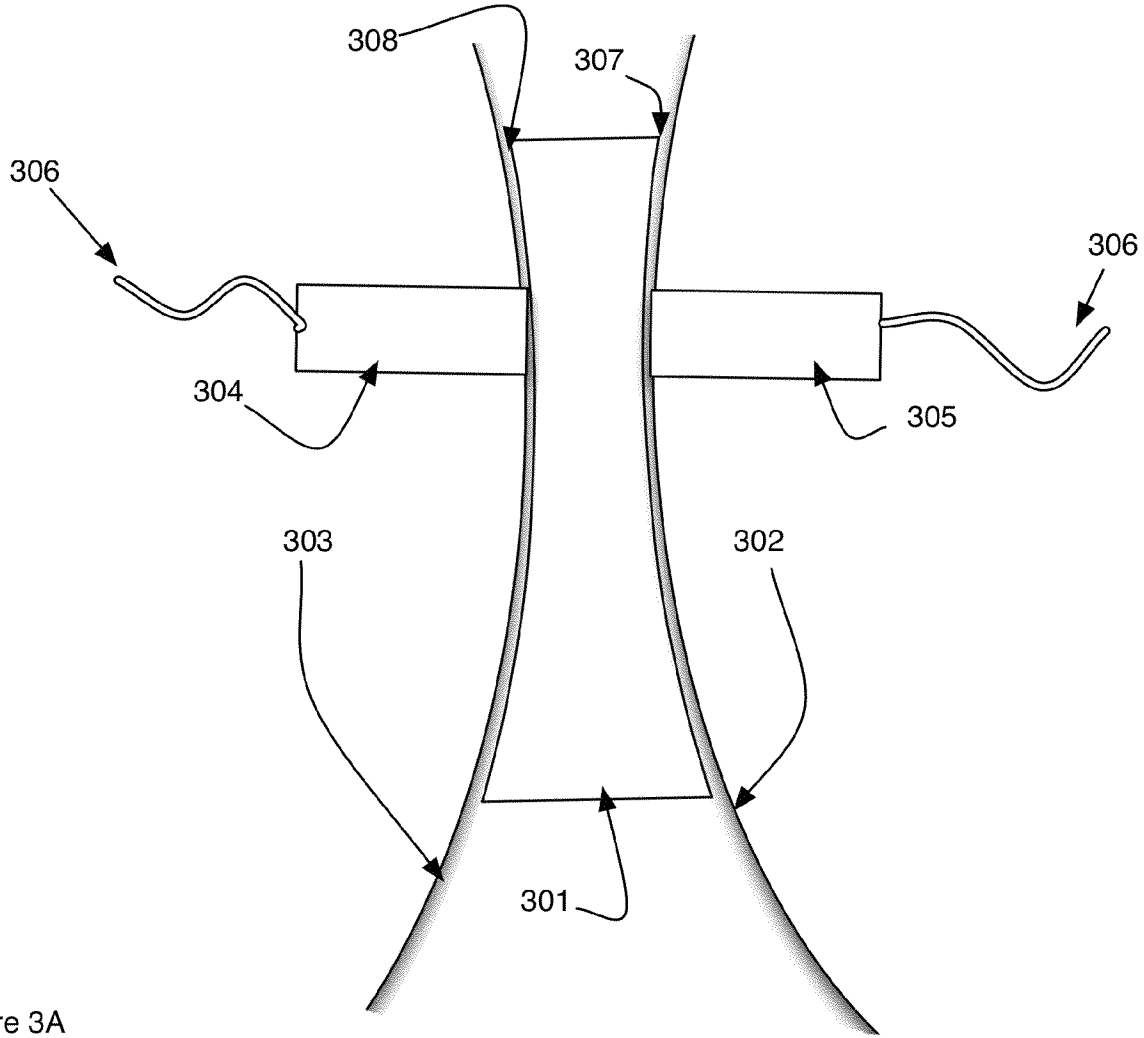
FIGS. 3A and 3B are diagrams of the communication block.
Figure 3B:
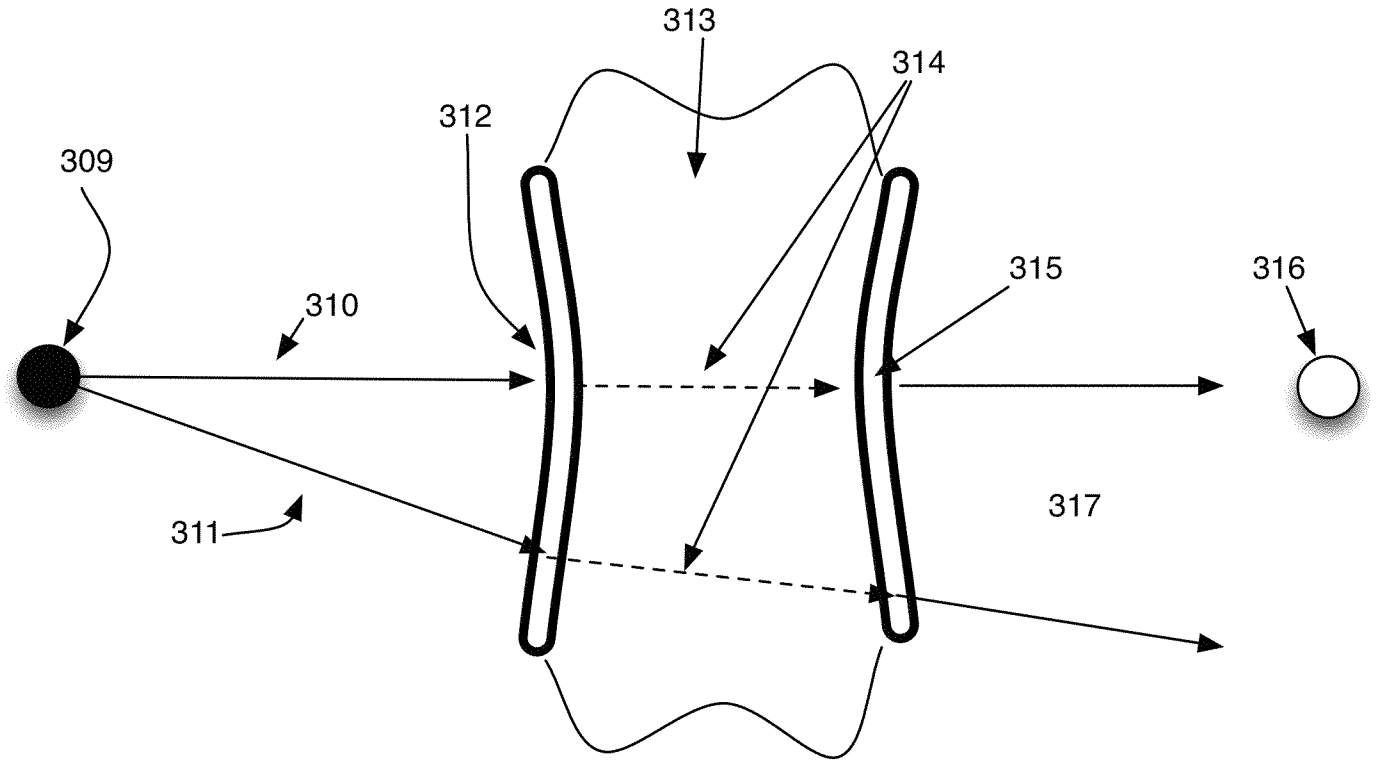

Referring now to FIGS. 3A and 3B the details of the communication block are shown. The communication block 301 is positioned between the walls 302, 303 of two adjoined housings within a common frame of a single free vehicle platfrom. If a plurality of housings are joined together then there would be a communication block positioned between each of the housings where communication between the housings is needed. It is known in the art that seawater attenuates electromagnetic energy in the RF frequencies. In one embodiment the communication block 301 displaces seawater from the outer surfaces 307, 308 and the region between the adjoined housings, providing an RF 'window". Communication devices 304, 305 are positioned within the free vehicles such that an electromagnetic signal may be propagated from one housing to the adjoined housing. Within the housings the communication devices are connected by wire 306 to their respective control boards. In one embodiment the communication devices act as point sources 309, 316 for the electromagnetic signal. The signal is propagated, 310, 311 from a first communication device through the air within the first housing through the wall 312 of the first housing, into the interstitial region 313 of the communication block, through the wall 315 of the second housing and through the air within the second housing 317 to the receiver within the second housing. The electromagnetic wave is refracted at each surface interface according to Snell's law as is known in the art. The material of the communication block 313 is selected to provide a watertight boundary between the adjoined housings and to optimize transmission of the electromagnetic signal 314 through the communication block. In one embodiment the electromagnetic signal is a radio wave, and the material of the communication block is one selected from polyurethane, polystyrene, epoxy, silicone, polyalkenes, and wax. In another embodiment the electromagnetic signal is an optical signal and the material of the communication block is one selected from polycarbonate, optically clear polyurethanes, optically clear silicones and other optically clear water repellant polymeric materials as are known in the art. In all cases the relative geometric positions of the transmitting 309 and receiving 316 communication components are selected to optimize signal strength based upon refraction at each of the interface surfaces. In another embodiment communication between adjoined housings containing a plurality of communication devices is selectively controlled by selecting materials and positions such that a first communication signal is internally reflected at the interfaces between the housings and a second communication signal is selectively transmitted through the communication block using material selection and Snell's law to select material and position.

Figure 4:
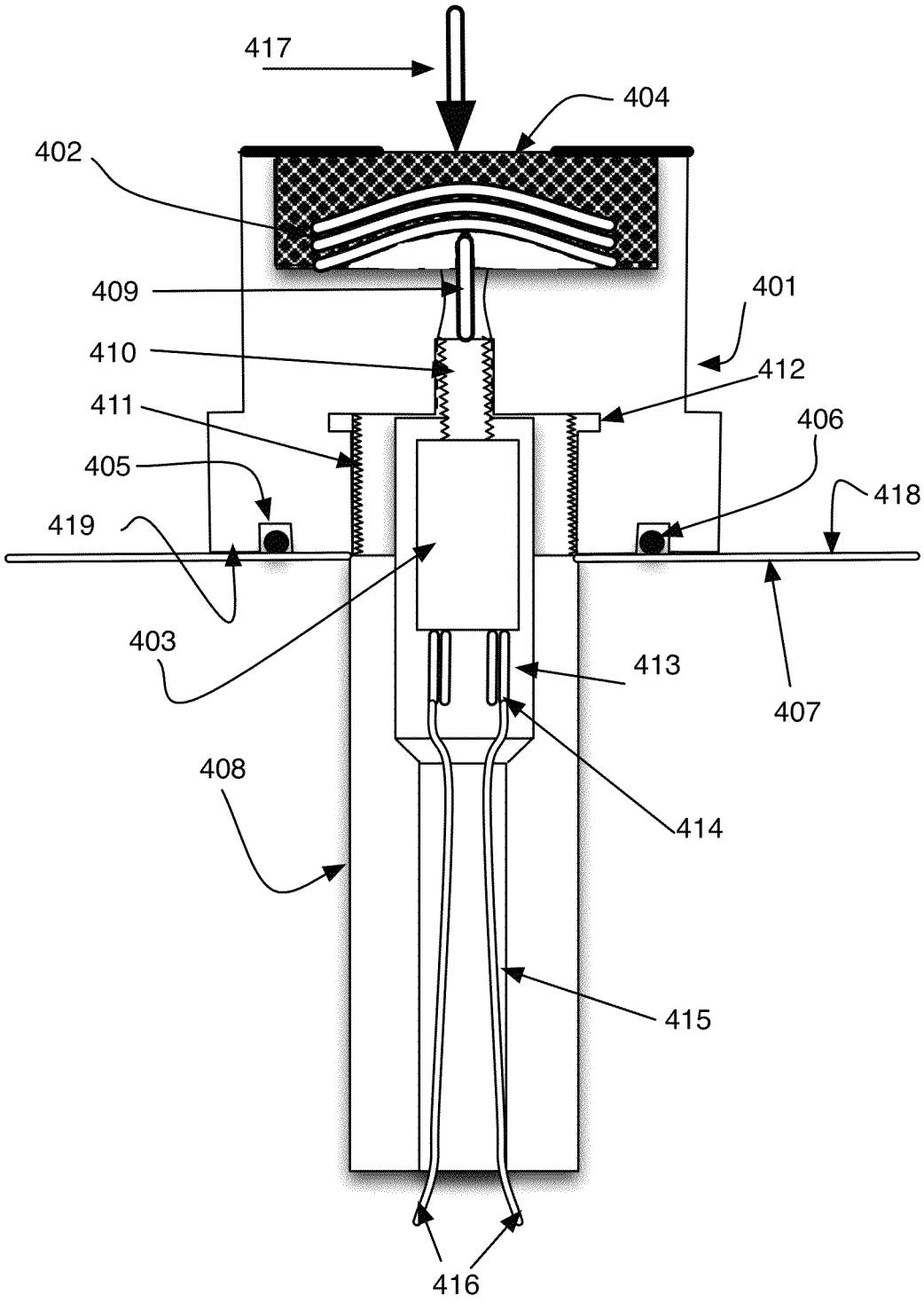
FIG. 4 is a block diagram of a pressure activated switch embodiment of the invention.

Referring now to FIG. 4, details of the pressure switch component of the free vehicle are shown. A cross-sectional view of the pressure switch component is shown. The pressure switch is comprised of a switch body 401 and within the switch body is an electrical switch 403 that is actuated by a push rod 409, that is part of the switch 403, and fits within a threaded collar 410. The push rod is in contact with flexible domes 402. In the preferred embodiment the domes are equivalent to metal domes manufactured by Snaptron Inc, of Windsor Colo., USA. The domes are encapsulated below a layer of a polymeric material 404. Pressure 417 on the surface 404 of the polymeric material causes the flexible domes 402 to flex and actuate the push rod 409 that in turn activates the switch 403. The pressure is causes by increased water depth as the free vehicle submerges and thereby activates the switch when the free vehicle passes a pre-selected depth. The depth at which the switch is activated is selected by variation in the stiffness and quantity of the domes 402 and the modulus of the encapsulant material 404. Non-limiting examples of encapsulant material include silicone, polyurethane, rubber, and other polymeric materials both filled and unfilled. The threaded collar 410 screws into the switch body 401 thus positioning the pushrod 409 in contact with the domes 402. The housing further includes a second threaded region 411 that mates with a threaded hollow shank 408. The threaded hollow shank passes through the wall of the housing 407. If the housing is glass, the hole is smooth and untapped. If the housing were metallic or plastic, the hole could be tapped to match the thread on the exterior of the threaded hollow shank 408. The switch body 401 is pulled against the exterior wall 407 of the housing when the threaded hollow shank 408 is drawn down by tightening a hex nut (not shown) on the interior of the housing. In an alternate embodiment, not illustrated, threaded hollow shank 408 is screwed into a threaded region of a metallic or plastic end cap. As the switch body 401 is drawn against the housing 407 the switch body seals against the outer surface 418 by compressing O-rings 406 that is held in groove 405 located on the bottom surface 419 of the switch body 401. The switch 403 is located within an upper hollow interior core 413 of the threaded hollow shank 408. Wires 416 connect to the switch terminals 414 and pass through the lower hollow interior core 415 and are connected to the control board (not shown). In one embodiment pressure 417 on the switch turns the switch "off" or disconnects wire leads 416. Such would be the case for electrical components that are to be turned off as the free vehicle submerges. In another embodiment the leads 416 are connected by a switch that is turned "on" by pressure 417. Such would be the case for components that are to be activated at a pre-selected depth as the free vehicle submerges. In another embodiment, three leads 416 would serve both functions, turning one circuit "off", while turning another circuit "on".

Figure 5:
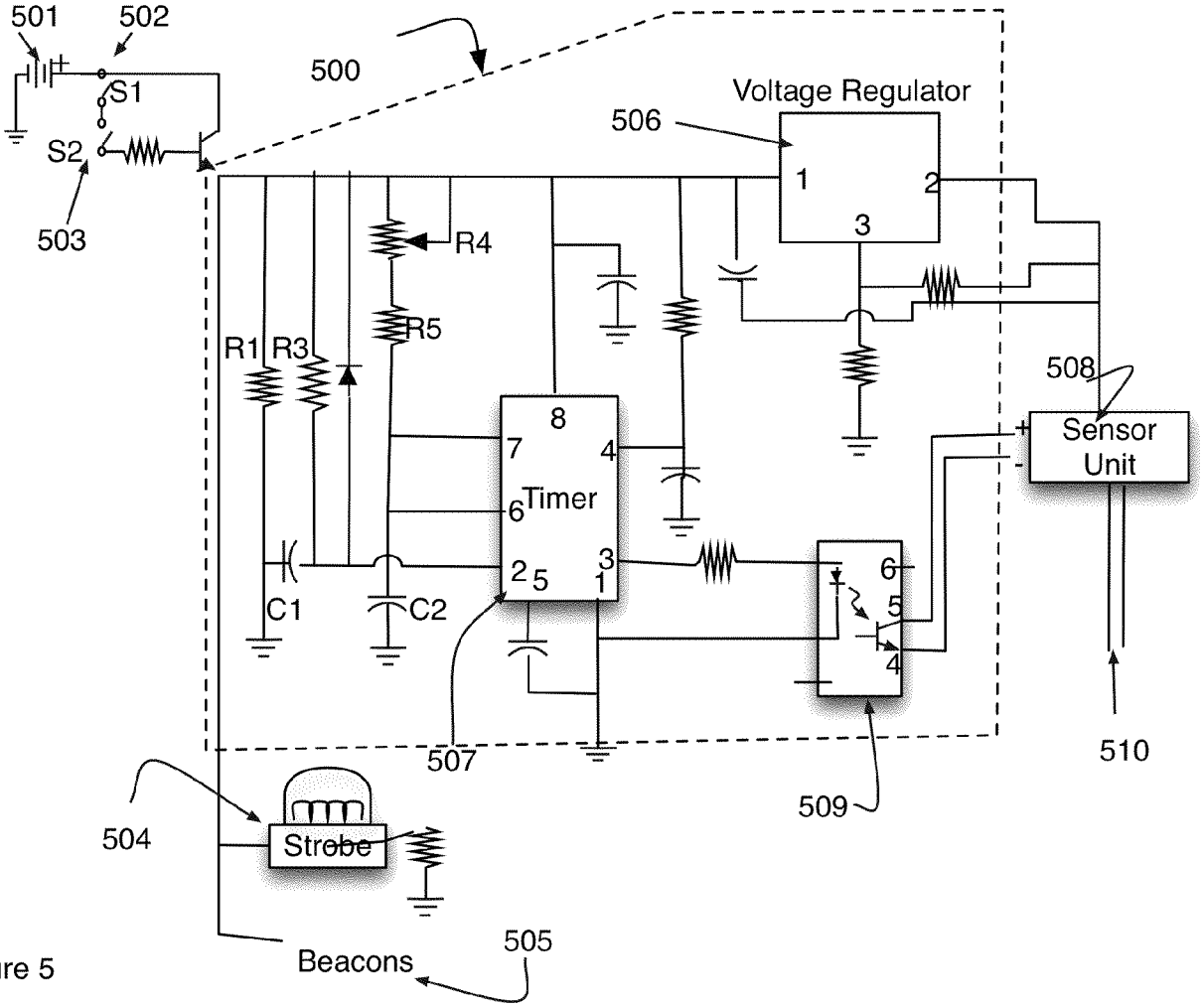
FIG. 5 is a circuit diagram of an electronic switch control element of the invention.

FIG. 5 shows an embodiment of the control board 500 included in a free vehicle. The control board is comprised of the components contained within the dashed lines and connects other components, some of which are also shown in FIG. 5, that are part of the free vehicle and located off of the control board. Power to the control board is controlled by a pair of switches S1 502 and S2 503 connected to a power supply 501. In a preferred embodiment S1 is the pressure switch discussed above in conjunction with FIG. 4 and S2 is a magnetically actuated switch. No power is supplied to the control board unless both switches are closed. Active components on the control board include a timer circuit 507, a voltage regulator 506, and an opticoupler 509. In a preferred embodiment the timer is an NE555 timer known in the art with pin out connectors as shown in Table 1.

TABLE 1

NE555 Timer Pin outs

| Pin | Name |
|---|---|
| 1 | Ground |
| 2 | Trigger |
| 3 | Out |
| 4 | Reset |
| 5 | Control |
| 6 | Threshold |
| 7 | Discharge |
| 8 | Voltage, Supply |

The NE555 timer is connected to multiple RC circuits. The first comprised of R1, R3 and C1 are connected to the Trigger. The RC circuit is activated upon closure of switches S1 and S2 and delays the activation of the timer trigger to allow the timer and the voltage regulator 506 to stabilize. The time delay is adjustable depending upon the time constant of the RC circuit of R1, R3 and C1. The RC circuit of R1, R3 and C1 results in the timer acting in "single edge" mode. Single edge mode means that a single pulse will be sent by the timer when power is applied to the control board. The second RC circuit comprised of R4, R5 and C2 applied to ports 6 and 7 of the 555 timer result in a pulse being send to out port 3 of the 555 timer and the length of the pulse is determined by the time constant of the second RC circuit. The output pulse is applied to the input of an opticoupler 509 that isolates the timer from the sensor unit 508. The pulse at the sensor 508 activates the sensor. In a preferred mode the sensor 508 is a GPS sensor equivalent to the DC40 tracking collar made by Garmin International, Inc. 1200 East 151ST St., Olathe, Kans. 66062

USA. The DC40 sensor includes a global positioning sensor to detect the position of the free vehicle when at the ocean surface and also includes a VHF radio 510 to broadcast that position to a recovery ship. Also included on the control board is a voltage regulator 506 to provide power to the sensor unit at the required voltage. In another embodiment a plurality of sensors are connected to the timer through a plurality of opticouplers.

In another embodiment at the same time the control board is activated through closing of S1 and S2 a strobe 504 is activated as well as other beacons 505. Nonlimiting examples of other beacons 505 include additional visible beacons, acoustic beacons, radio directional finder beacon, and other frequency broadcasting beacons.

Figure 6:
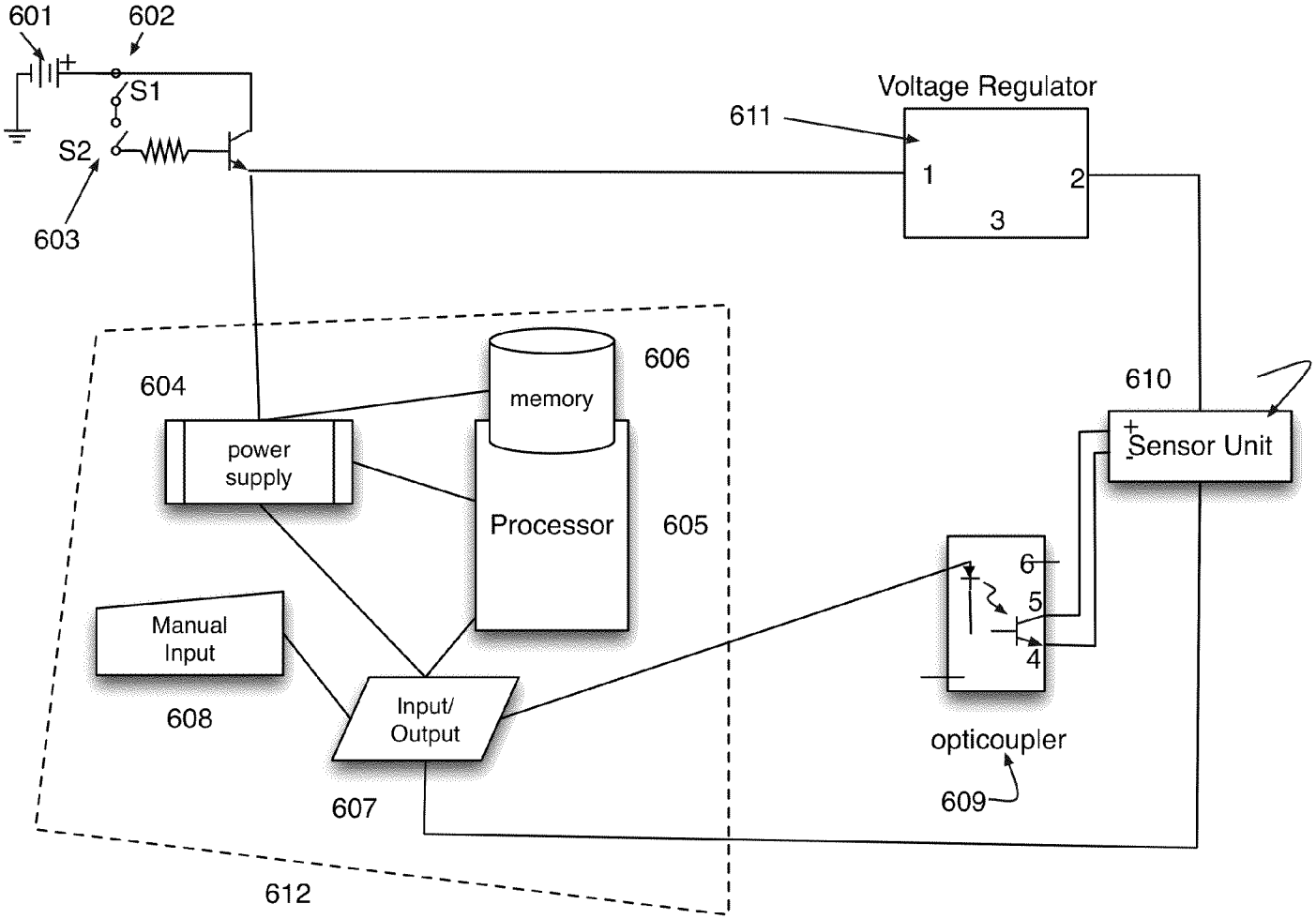
FIG. 6 is a block diagram of an electronic switch control further incorporating a microprocessor.

In another embodiment the control board of FIG. 5 is replaced by the system diagrammed in FIG. 6. This alternate control board and system includes the same switches S1 602 and S2 603 connected to a power supply 601. A voltage regulator 611 provides the appropriate voltage power to a sensor unit 610 and the sensor is activated through a pulse received through the opticoupler 609. The system further includes a computing device 612. The computing device is comprised of a processor 605 a power supply 604 that receives power from the closures of S1 and S2 and supplies power to the internal components of the computing device 612. The computing device further includes a processor 605, memory 606 that includes instructions to program the processor 605, a manual input means 608 such as a keyboard or series of buttons or touch screen that allows input to the processor of programming instructions to be stored in memory and an input/output means 607 such as a USB or other output that can programmably output a voltage to selected pins or connectors. In practice the instructions in memory control the processor to sense for a power "on" state by voltage applied to the power supply, wait for a preselected time and then send a single pulse out the output; the single voltage pulse having a preselected magnitude and duration, thereby mimicking the action of the control board of FIG. 5. The control system of FIG. 6 can further take input from a variety of sensors and control the sensors by controlling the output at the I/O sending control signals to programmable sensors as are known in the art.

Figure 7A:
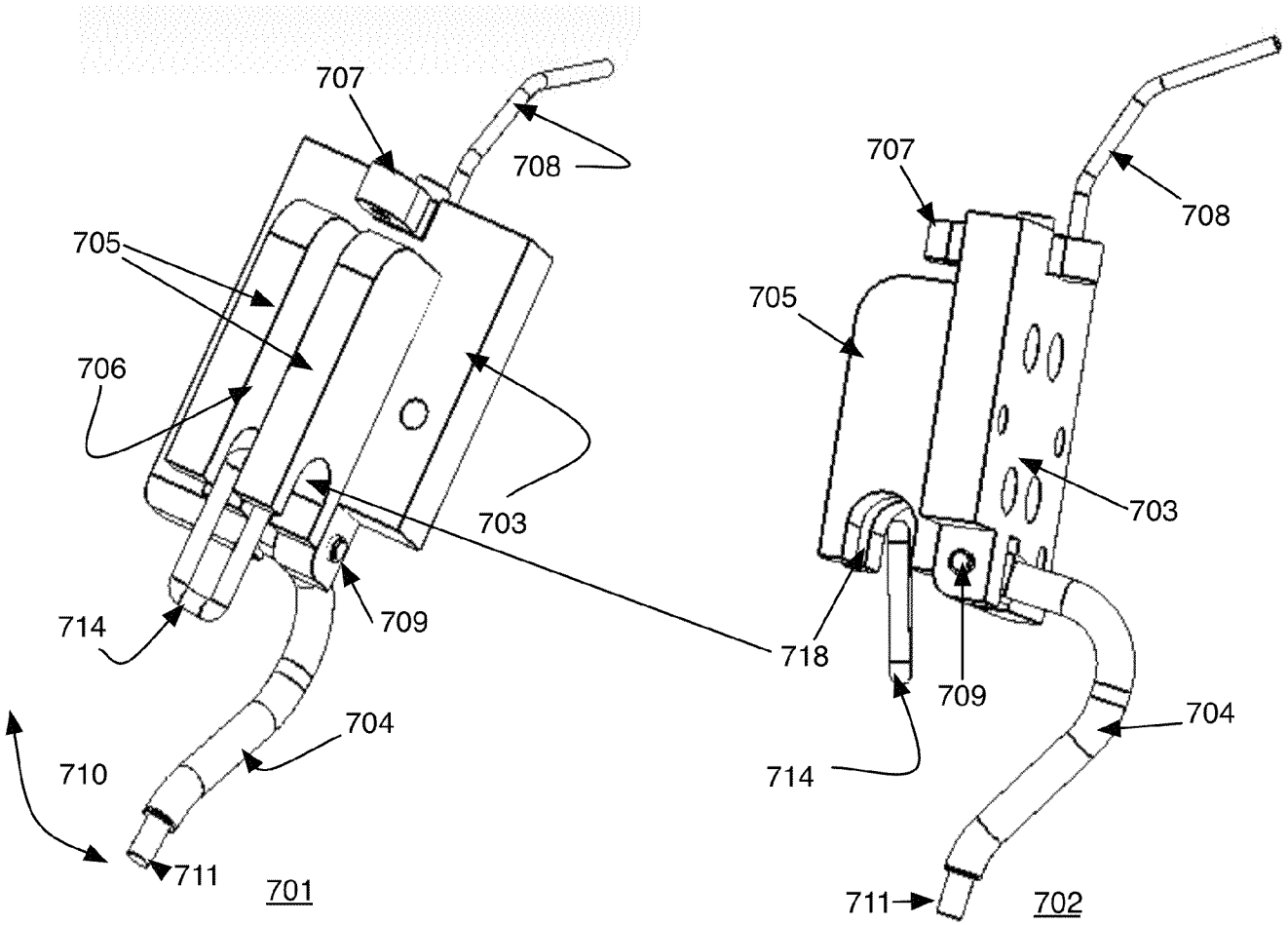
FIGS. 7A and 7B are diagrams of a first embodiment of an anchor attachment mechanism.
Figure 7B:
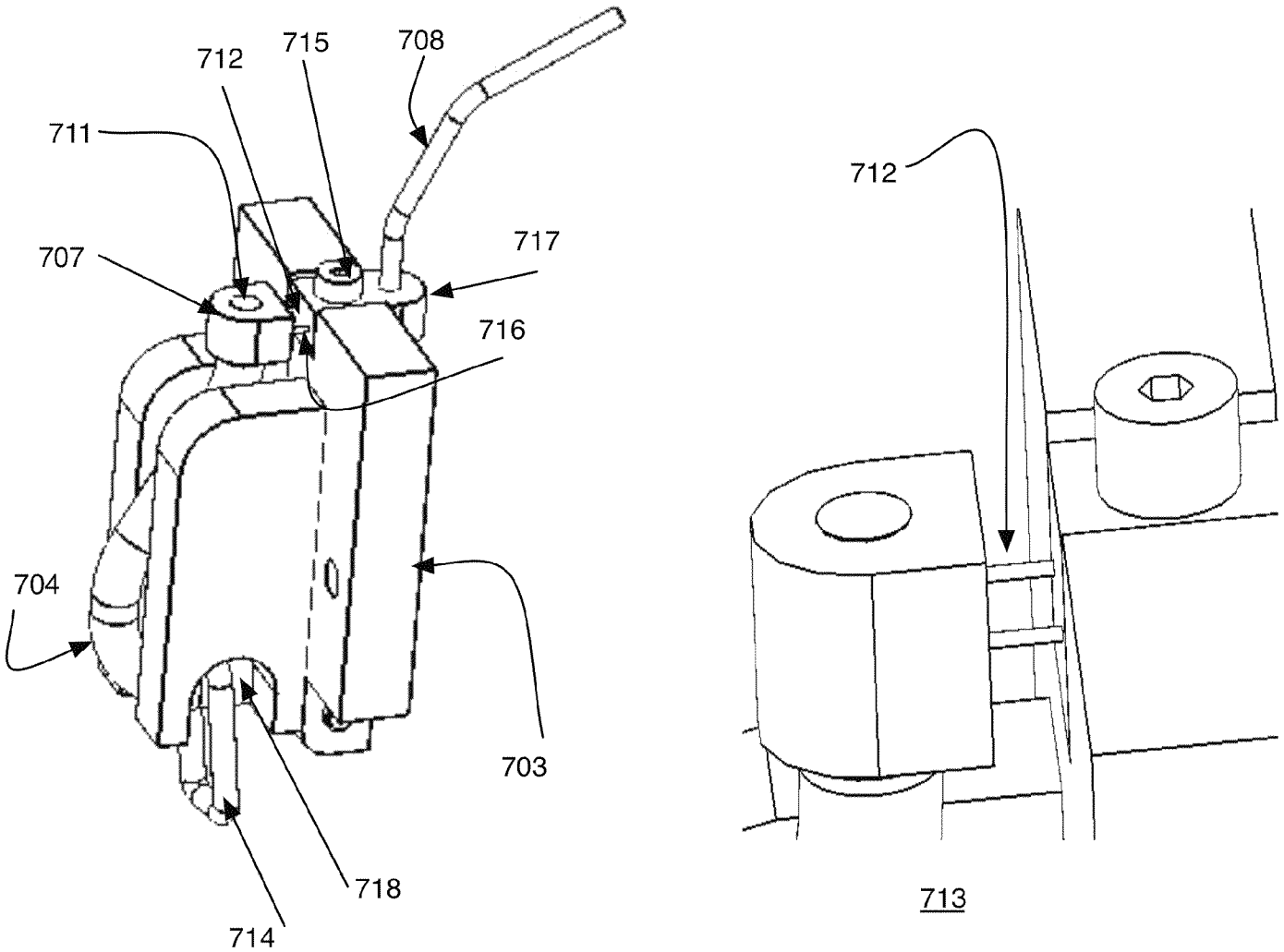

A means to attach and detach a free vehicle to an anchor is required to reliably submerge the free vehicle and then release it to float back to the surface after a pre-selected time or event. Referring now to FIGS. 7A, 7B, 8A and 8B two mechanisms are shown to attach and detach the free vehicle to an anchor. The first mechanism is shown in FIGS. 7A and 7B. A front view 701 and a back view 702 of a single pelican hook mechanism are shown. The anchor attachment mechanism is comprised of a base plate 703 to which is attached a pair of side plates 705 spaced apart to form a slot 706 a pelican hook 704 is attached to the side plates 705 via a hinge pin 709 such that the pelican hook may be rotated in the direction shown 710 to fit into the slot 706. When fully rotated up and closed, the top 711 of the pelican hook 704 mates with a latch 707 to hold the pelican hook in a closed position. In practice the pelican hook is threaded through a shackle, eye, carabineer, ring, link or loop 714 that are attached to the anchor or other device attached to the link (not shown) and that are held in a u-shaped receiver 718 when the pelican hook is rotated upward to the closed position as shown in FIG. 7B. When released the pelican hook 704 is shaped such that the weight of the anchor or other device pulls down on the pelican hook and returns it to the open position shown in FIG. 7A. The latch 707 further includes a release mechanism 712 best seen in FIG. 7B with a close up view 713. In the preferred embodiment the release mechanism includes at least one fusible wire 712 that is electrolytically corroded when power is supplied through the connector 708. In another embodiment the wire 712 is replaced with an electromagnetic release such as a solenoid. The release mechanism includes a semi-cylindrical element 707 that includes a hole in which the end of the pelican hook fits. The first semi-cylindrical element 707 is connected to a second semi-cylindrical element 717 by means of at least 1 fusible wire 712. Two fusible wires are shown in FIG. 7B. The second semi-cylindrical element 717 is bolted 715 within a notch 716 cut in one edge of the base plate 703 of the anchor release mechanism. A wire 708 is connected to the second semi-cylindrical element that can supply power to cause galvanic corrosion of the at least one fusible link wire 712 causing the wires to break and releasing the first semi-cylindrical element from the second and allowing the end 711 of the pelican hook 704 to rotate away from the base plate 703 and open thereby releasing any attachment such as the link 714 as shown in FIG. 7B. Alternate embodiments may use other implementations of the fusible wire 712 to secure the top 711 of the pelican hook to the base plate 703.

In another embodiment the anchor attachment mechanism is attached to a sampling device, rather than an anchor, that is likewise activated by release of the pelican hook. The sampling device release is controlled by the control board and may be done on the basis of depth, such as can be triggered by the pressure switch, time or other sensor measurements nonlimiting examples include sonic or ultrasonic detectors for movement, chemistry detectors such as pH, temperature sensors, and optical sensors. Nonlimiting exemplary devices that may be activated by the anchor release mechanism include water sampling devices, earth or ocean bottom sampling devices and netting to capture living creatures.

Figure 8A:
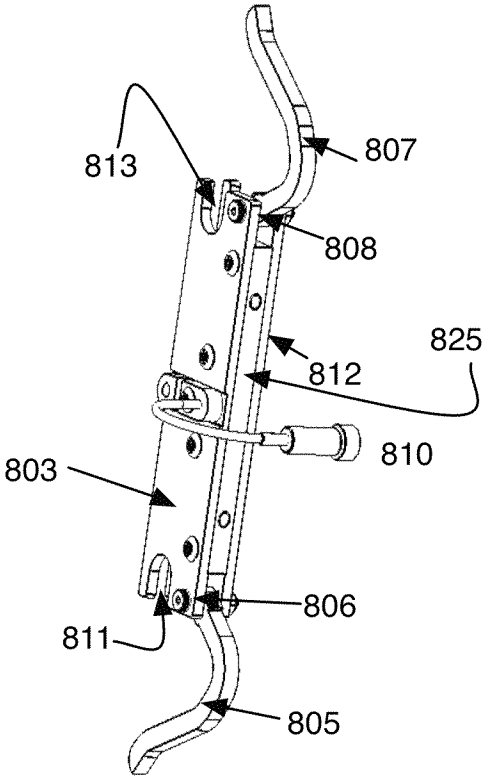
FIGS. 8A and 8B are diagrams of a second embodiment of an anchor attachment mechanism.
Figure 8A:
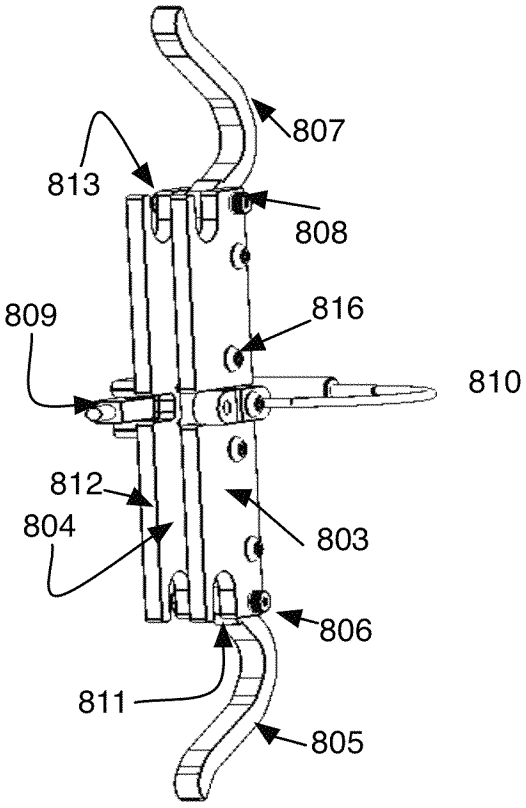
Figure 8B:
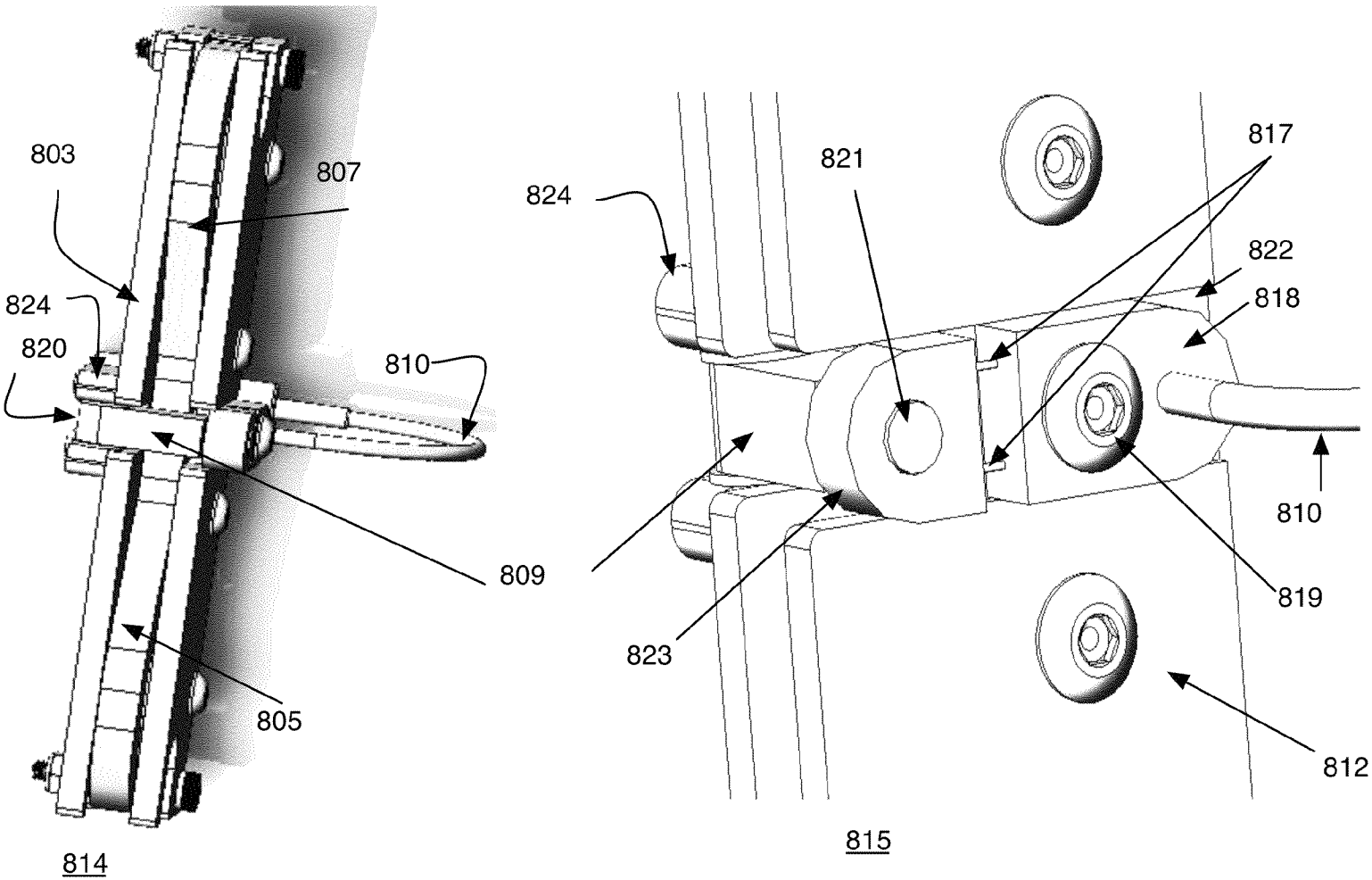

In another embodiment shown in FIGS. 8A and 8B an anchor attachment mechanism includes a pair of opposing pelican hooks 805, 807 restrained by a fusible wire 817. In FIG. 8A a front perspective view 801 and a rear perspective view 802 are shown. The two-hook anchor attachment mechanism can be used to provide a release of certain water sampling devices with two endcaps and a center spring, such as Niskin bottles, twin sampling booms, or as a redundant release mechanism from an anchor. In another embodiment the two hook system is used to release or activate two devices that are individually activated by release of a pelican hook. Typical devices are as already discussed in conjunction the single hook device of FIGS. 7A and 7B. The two hook release mechanism is comprised of a pair of flat rectangular side plates 803, 812 which are attached parallel to and spaced apart by a spacer block 825 forming an inner slot 804 the pelican hooks 805, 807 are attached by hinge pins 808, 806 within the inner slot and can be rotated about the hinge pins. The plates are held to the spacer block using screws, rivets, glue or welds. Screws 816 are used in the embodiment shown. When rotated into the slot as shown in FIG. 8B the pelican hooks are in a closed position and will secure a eye, link or loop attached to the pelican hook within the U-shaped cutouts 811, 813 located at each end of the rectangular side plates 803, 812. The pelican hooks are secured in the closed position with a release mechanism 809. The release mechanism is activated by electrical power applied to the insulated wire 810. The release mechanism works similarly to that already described for the single hook system. In the instant case the release mechanism secures (and release) two pelican hooks simultaneously. Referring to FIG. 8B a front perspective view 814 of the two-hook system in a closed position and a close up view 815 of the release mechanism are shown. The release mechanism is seen to be comprised of a latching bar 809 that rotates about a hinge pin 820 at one end attached to the side plate 803 by a block 824 and thereby allowing the latching bar to be rotated across and fit into notches in the walls 803, 812 of the two hook mechanism. When in the position as shown in FIG. 8B the latching bar locks both pelican hooks 805, 807 in the closed position. The release mechanism is comprised of a first semi-cylindrical element 823 that includes a hole through which the end 821 of the bar 809 is placed. The first semi-cylindrical element is secured to a second semi-cylindrical element 818 by at least one fusible link 817. Two fusible links are shown in the Figure. The second semi-cylindrical element is bolted 819 in place in a groove 822 cut in the flat surface of the wall 812 of the two-hook mechanism. When electrical power is applied through the insulated wire 810 the link(s) 817 are galvanically corroded thereby releasing the first semi-cylindrical element 820 and the latching bar rotates to an open position thereby simultaneously releasing both of the pelican hooks which then rotate to the open position shown in FIG. 8A. In another embodiment the fusible links are replaced with an electromechanical actuator such as a solenoid. Alternate embodiments may use other implementations of the fusible wire 817 to secure the top 812 of the latching bar 809 to the base plate 703.

SUMMARY

A free vehicle suitable to serve as a platform to carry a variety of equipment to the ocean floor, actuate devices at the floor and at intermediate points on the way to and returning from the ocean floor is described. The free vehicle includes standardized power, control electronics, navigation equipment and mechanical release mechanisms that can be used in conjunction with custom experiments. Exemplary experiments include sensors and sampling equipment used for deep-sea exploration. The free vehicle platform provides for scalable designs to meet scientific needs and surface vessel constraints.

Those skilled in the art will appreciate that various adaptations and modifications of the preferred embodiments can be configured without departing from the scope and spirit of the invention. Therefore, it is to be understood that the invention may be practiced other than as specifically described herein, within the scope of the appended claims.

What is claimed is:

1. A free vehicle for ocean exploration comprising:

a) a first housing having an inside, an outside, an inside surface, and, an outside surface, the first housing sealed against passage of water from the outside to the inside, b) an area on the inside of the first housing for carrying cargo, c) at least one of a magnetically actuated switch attached to an inner wall of the first housing and the magnetically actuated switch positioned such that the magnetically actuated switch can be activated by placing a magnet on the outside of the first housing and near the magnetically actuated switch, d) at least one of a pressure activated switch attached to the first housing and extending from the outside to the inside, said at least one pressure activated switch including at least one flexible dome embedded in a polymer matrix, the polymer matrix having a modulus, and, the polymer matrix exposed to the outside of the first housing, the at least one flexible dome in contact with a switch mechanism such that pressing on the at least one flexible dome activates the switch mechanism, and pressure applied to the polymer matrix causes the at least one flexible dome to flex, thereby activating the switch mechanism, and, a quantity of the at least one flexible domes and the modulus of the polymer matrix both selected to cause activation of the switch mechanism at a pre-selected pressure, as a pressure on the outside of the first housing changes as the first housing is submerged in an ocean environment, e) a control board located on the inside of the first housing, the control board including a pulsed switching mechanism that provides a single electrical pulse of a pre-selected duration and with a pre-selected delay after power is supplied to the control board from a power supply that is connected in series with one of: the at least one magnetic switches and the at least one pressure activated switches, f) a global position sensor that is activated by the single electrical pulse of the control board, said global position sensor including a satellite sensor to determine a location of the first housing, and, a VHF radio that broadcasts the position of the first housing, g) a mechanical release mechanism attached to and located on the outside of the first housing, said mechanical release mechanism comprising at least one pelican hook and a hinge, the at least one pelican hook attached to the hinge such that the at least one pelican hook may be rotated about the hinge to a closed position and thereby latching at least one of: an eye, a hook, and, a loop, to the first housing, and, said release mechanism including a fusible link that locks the at least one pelican hook in the closed position, and, breaking the fusible link releases the pelican hook to an open position thereby releasing the at least one: eye, hook, and, loop, from the first housing.

2. The free vehicle of claim 1 wherein the release mechanism is electrically connected to at least one of the at least one pressure activated switches and the release mechanism is activated and releases when a pre-selected pressure is applied to the connected pressure activated switch.

3. The free vehicle of claim 1 wherein the fusible link is a wire that is galvanically corroded when electrical power is supplied to the mechanical release mechanism.

4. The free vehicle of claim 1 wherein the first housing is comprised of a pair of hemispheres joined to form a sphere.

5. The free vehicle of claim 4 wherein the pair of hemispheres are made of glass or plastic.

6. The free vehicle of claim 1 wherein the control board is comprised of an NE555 timer, an optical coupler and a voltage regulator, the NE555 timer having a first resistor capacitor circuit, said first resistor capacitor circuit having a resistance and a capacitance, and, said first resistor capacitor circuit supplying input voltage to pins 6 and 7 of the NE555 timer, the resistance and capacitance of the first resistor capacitor circuit chosen to select a duration for a single output voltage pulse from pin 3 of the NE555 timer, and, a second resistance capacitance circuit, said second resistor capacitor circuit having a resistance and a capacitance, and, said second resistor capacitor circuit supplying input voltage to pin 2 of the NE555 timer, the resistance and capacitance of the second resistor capacitor circuit chosen to select a delay before the single output voltage pulse from pin 3 when a power supply is connected to the control board and supplies power to the first and second resistor capacitor circuits.

7. The free vehicle of claim 1 wherein the control board is comprised of a microprocessor, a voltage regulator, and, an optical coupler wherein the microprocessor is programmed to output a single voltage pulse of a pre-selected duration after a preselected delay once power is supplied to the control board and microprocessor.

8. The free vehicle of claim 1 further comprising a second housing, said second housing having an inside, an outside, an inside surface and an outside surface, said second housing adjoined to the first housing at a point of connection by a communication block, said communication block comprising a plastic block shaped to fit snugly to the outside surfaces of the first and second housing and exclude water from the point of connection and thereby allowing wireless communication of an electromagnetic signal between the first housing and the second housing when both housings are immersed in water.

9. The free vehicle of claim 1 further comprising a plurality of additional housings, each of said additional housings having an inside, an outside, an inside surface and an outside surface, at least one of said additional housings adjoined to the first housing at a point of connection by a communication block, said communication block comprising a plastic block shaped to fit snugly to the outer surfaces of the first and the at least one additional housing and exclude water from the point of connection, and, thereby enabling wireless communication of an electromagnetic signal between the first housing and the at least one additional housing when the first and the at least one additional housing are both immersed in water.

* * * * *